United States Patent [19]

Ramachandran et al.

[11] Patent Number: 4,582,615

[45] Date of Patent: Apr. 15, 1986

[54] BENTONITE-SULFATE FABRIC SOFTENING PARTICULATE AGGLOMERATE, PROCESSES FOR MANUFACTURE AND USE THEREOF, AND DETERGENT COMPOSITIONS CONTAINING IT

[75] Inventors: Pallassana N. Ramachandran, Robbinsville; Charles J. Schramm, Jr., Somerville, both of N.J.; H. Peter Lazecky, New York, N.Y.; Martin D. Reinish, Emerson, N.J.

[73] Assignee: Colgate Palmolive Co., New York, N.Y.

[21] Appl. No.: 674,899

[22] Filed: Nov. 26, 1984

[51] Int. Cl.[4] ..... D06M 11/00

[52] U.S. Cl. ..... 252/8.6; 252/89.1; 252/174.25; 23/313 R

[58] Field of Search ..... 252/8.6, 89.1, 174.25, 252/140; 23/313 R, 313 FB, 313 P

[56] References Cited

U.S. PATENT DOCUMENTS

| | | | |
|---|---|---|---|
| 3,451,935 | 6/1969 | Roald et al. | 252/135 |
| 3,852,211 | 12/1974 | Ohren | 252/110 |
| 3,966,629 | 6/1976 | Dumbrell | 252/140 |
| 4,419,250 | 12/1983 | Allen et al. | 252/90 |
| 4,421,657 | 12/1983 | Allen et al. | 252/90 |
| 4,472,287 | 9/1984 | Ramachandran et al. | 252/8.7 |
| 4,482,471 | 11/1984 | Allen et al. | 252/90 |
| 4,482,477 | 11/1984 | Allen et al. | 252/90 |
| 4,482,630 | 11/1984 | Allen et al. | 252/90 |

*Primary Examiner*—Paul Lieberman
*Assistant Examiner*—Willie J. Thompson
*Attorney, Agent, or Firm*—Bernard Lieberman; Murray M. Grill; Herbert S. Sylvester

[57] ABSTRACT

Agglomerated particles of finely divided fabric softening bentonite and sodium sulfate particles have been found to possess improved fabric softening properties, compared to agglomerated bentonite, especially when employed in the hand washing of laundry which is subsequently line dried. Such agglomerates are also of excellent particle strength and are readily dispersible in water. The described product may be made by agglomerating finely divided bentonite and sodium sulfate powders with the aid of excess moisture, after which the agglomerated particles resulting are dried and those of desired size, preferably in the No's. 30 to 100 sieve size range (U.S.), are obtained. The fabric softening agglomerate made may be mixed with spray dried synthetic organic anionic detergent composition beads of about the same or higher bulk density, preferably in the 0.3 to 0.5 g./cc. range, with about 5 to 30% of the agglomerate particles being present, to make a non-segregating fabric softening particulate detergent composition of improved softening properties.

12 Claims, 2 Drawing Figures

Figure 1:
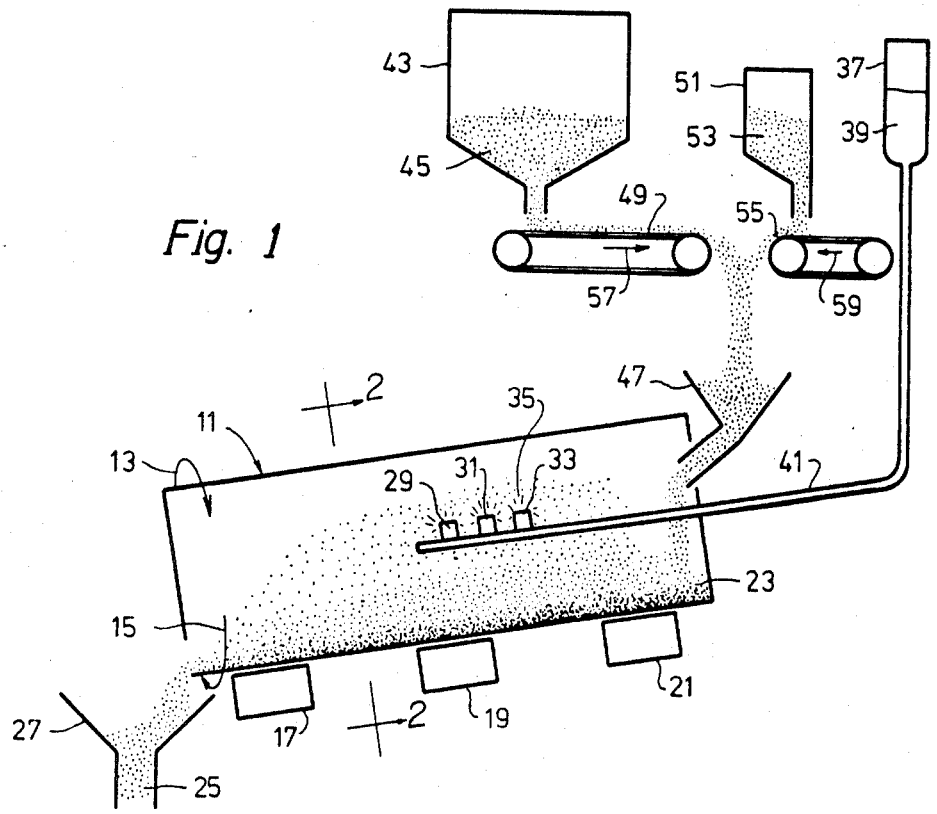

BENTONITE-SULFATE FABRIC SOFTENING PARTICULATE AGGLOMERATE, PROCESSES FOR MANUFACTURE AND USE THEREOF, AND DETERGENT COMPOSITIONS CONTAINING IT

This invention relates to agglomerating particles of finely divided fabric softening bentonite and sodium sulfate. More particularly, it relates to such agglomerates wherein the proportion of sodium sulfate is minor. Thus, the proportion of bentonite to sodium sulfate, both of which, before agglomeration, are in finely divided form, is in the range of 2:1 to 10:1, preferably 3:1 to 5:1.

In the synthetic organic detergent art it is recognized that certain smectite clays, such as bentonite, exhibit fabric softening properties when incorporated in or used with built synthetic organic detergent compositions. Such clays have been mixed with detergent composition components in the crutcher and have been spray dried with such components to make spray dried fabric softening particulate detergents. Instead of spray drying the fabric softening clay together with the other constituents of the detergent composition, it has sometimes been preferred to agglomerate the clay, often with the aid of a binding agent, such as sodium silicate, in aqueous solution, to make agglomerates of approximately the same size as spray dried detergent composition beads, so that the agglomerates may be mixed with the spray dried detergent beads to produce particulate fabric softening detergent compositions.

Sodium sulfate is a known constituent of many detergent compositions, sometimes because it is present as a byproduct of neutralization of detergent acid mixes containing sulfuric acid. In other instances it is present as a filler. However, sodium sulfate is not a fabric softener and has not been incorporated in detergent compositions for such purpose. In U.S. Pat. No. 3,966,629 it was mentioned, along with many other sodium and potassium salts, as a possible carrier for clays, such as bentonite, to be employed as fabric softeners in detergents, but the weight ratio of the carrier in such applications was greater than that for the bentonite, and therefore would not be useful in applicants' compositions.

In accordance with the present invention a fabric softening bentonite-sodium sulfate agglomerate comprises agglomerate particles of sizes in the range of No's. 10 to 140 sieves, U.S. Sieve Series, which are agglomerates of mixtures of finely divided bentonite and sodium sulfate, with at least a major proportion by weight of each of the bentonite and sodium sulfate particles being less than No. 100 sieve size, with the proportions of bentonite and sodium sulfate being within the range of one part of sodium sulfate by weight to 2 to 10 parts of bentonite by weight, with the bentonite and sodium sulfate particles being held together in the agglomerate particles by hydrated bentonite and hydrated sodium sulfate at the surfaces of said particles, and with the agglomerate particles being of a moisture content in the range of 6 to 16%, by weight. Also within the invention are fabric softening particulate detergent compositions in which such agglomerates are included, a process for the manufacture of the agglomerates, and methods for use thereof to soften laundry fabrics.

The bentonite employed is a colloidal clay (aluminum silicate) containing montmorillonite. Montmorillonite is a hydrated aluminum silicate in which about 1/6th of the aluminum atoms may be replaced with magnesium atoms and with which varying amounts of sodium, potassium, calcium, magnesium and other metals, and hydrogen, may be loosely combined. The type of bentonite clay which is most useful in making the invented agglomerated particles is that which is known as sodium bentonite (or Wyoming or western bentonite), which is normally a light to cream-colored impalpable powder which, in water, forms a colloidal suspension having strongly thixotropic properties. In water the swelling capacity of the clay will often be in the range of 3 to 15 ml./gram, preferably 7 to 15 ml./g., and its viscosity, at a 6% concentration in water, will often be in the range of 3 to 30 centipoises, preferably 8 to 30 centipoises. Preferred swelling bentonites of this type are sold under the trademark Mineral Colloid, as industrial bentonites, by Benton Clay Company, an affiliate of Georgia Kaolin Co. These materials which are the same as those formerly sold under the trademark THIXO-JEL, are selectively mined and beneficiated bentonites, and those considered to be most useful are available as Mineral Colloid No's. 101, etc., corresponding to THIXO-JEL's No's. 1, 2, 3 and 4. Such materials have pH's (6% concentration in water) in the range of 8 to 9.4, maximum free moisture contents of about 8% and specific gravities of about 2.6, and for the pulverized grade at least about 85% (and preferably 100%) passes through a 200 mesh U.S. Sieve Series sieve. More preferably, the bentonite is one wherein essentially all the particles (over 90%, preferably over 95%) pass through a No. 325 sieve and most preferably all the particles pass through such a sieve. Beneficiated western or Wyoming bentonite is preferred as a component of the present compositions but other bentonites are also useful, especially when they form only a minor proportion of the bentonite used.

Although it is desirable to limit maximum free moisture content, as mentioned, the bentonite being employed should include enough free moisture, most of which is considered to be present between adjacent plates of the bentonite, to facilitate quick disintegration of the bentonite-sulfate agglomerate when such particles or detergent compositions containing them are brought into contact with water, such as wash water. It has been found that at least about 2%, preferably at least 3% and more preferably, at least about 4% or more of water should be present in the bentonite initially, before it is agglomerated, and such proportion should also be present after any drying. Overdrying to the point where the bentonite loses its "internal" moisture can diminish the utility of the present compositions, apparently because when the bentonite moisture content is too low the bentonite does not satisfactorily soften laundry by depositing on it from the wash water. When the bentonite is of satisfactory moisture content, and so is operative in the present invention, it can have an effective exchangeable calcium oxide percentage in the range of about 1 to 1.8; with respect to magnesium oxide such percentage will often be in the range of 0.04 to 0.41. A typical chemical analysis of such a material is from 64.8 to 73.0% of $SiO_2$, 14 to 18% of $Al_2O_3$, 1.6 to 2.7% of MgO, 1.3 to 3.1% of CaO, 2.3 to 3.4% of $Fe_2O_3$, 0.8 to 2.8% of $Na_2O$ and 0.4 to 7.0% of $K_2O$.

Instead of utilizing the THIXO-JEL or Mineral Colloid bentonites one may also employ equivalent competitive products, such as that sold by American Colloid Company, Industrial Division, as General Purpose Bentonite Powder, 325 mesh, which has a minimum of 95% thereof finer than 325 mesh or 44 microns in diameter (wet particle size) and a minimum of 96% finer than 200 mesh or 74 microns in diameter (dry particle size). Such a hydrous aluminum silicate is comprised principally of montmorillonite (90% minimum), with smaller proportions of feldspar, biotite and selenite. A typical analysis, on an "anhydrous" basis, is 63.0% silica, 21.5% alumina, 3.3% of ferric iron (as $Fe_2O_3$), 0.4% of ferrous iron (as FeO), 2.7% of magnesium (as MgO), 2.6% of sodium and potassium (as $Na_2O$), 0.7% of calcium (as CaO), 5.6% of crystal water (as $H_2O$) and 0.7% of trace elements. Also useful is a product sold by American Colloid Company as AEG-325 mesh sodium bentonite.

Although the western bentonites are preferred it is also possible to utilize synthetic bentonites, such as those which may be made by treating Italian or similar bentonites containing relatively small proportions of exchangeable monovalent metals (sodium and potassium) with alkaline materials, such as sodium carbonate, to increase the calcium ion exchange capacities of such products. Analysis of an Italian bentonite after alkali treatment shows it to contain 66.2% of $SiO_2$, 17.9% of $Al_2O_3$, 2.80% of MgO, 2.43% of $Na_2O$, 1.26% of $Fe_2O_3$, 1.15% of CaO, 0.14% of $TiO_2$ and 0.13% of $K_2O$, on a dry basis. It is considered that the $Na_2O$ content of the bentonite should be at least about 0.5%, preferably at least 1% and more preferably at least 2% (with the equivalent proportion of $K_2O$ also taken into account), so that the clay will be satisfactorily swelling, with good softening and dispersing properties in aqueous suspension, to accomplish the purposes of the present invention. Preferred swelling bentonites of the synthetic types described are sold under the trade names Laviosa and Winkelmann, e.g., Laviosa AGB and Winkelmann G 13.

The sulfate, which is employed with the bentonite in the agglomerate particles to increase fabric softening by the bentonite, is preferably anhydrous sodium sulfate, although partially hydrated sodium sulfate may also be useful in some applications. The anhydrous sodium sulfate has a greater hydrating capacity and therefore better, more secure holdings of hydrated sodium sulfate and bentonite particles together in the desired agglomerate may be achieved. The ability of the bentonite to form a gel with water also aids in binding the components together in the desired agglomerates, with the hydrated particle surfaces cementing the particles together.

The water employed is preferably of low hardness and inorganic salt contents but ordinary city waters may be used. Usually the hardness contents of such waters will be less than 300 p.p.m., as calcium carbonate, preferably less than 150 p.p.m., as $CaCO_3$, and the water will be used as a spray.

The agglomerating spray may also contain other components, especially minor, non-interfering adjuvants, which may desirably be incorporated with the bentonite-sulfate agglomerates. For example, in some instances dyes and/or pigments, such as Polar Brilliant Blue and ultramarine blue, respectively, may be employed, either dissolved or dispersed in the spray liquid. Other materials that may sometimes be present in the spray (or mixed with the powders) include nonionic detergents, fluorescent brighteners, perfumes, antibacterial compounds, sequestrants and binders. Among binders that sometimes are useful may be mentioned inorganic binders, such as sodium silicate, and organic binders, such as gums, e.g., sodium alginate, carrageenan, sodium carboxymethylcellulose and carob bean gum, gelatin, and resins, such as polyvinyl alcohol and polyvinyl acetate. However, it is a desirable and important feature of the present invention that agglomerates of satisfactory strength and ready dispersibility may be made without the use of binders, with only water being employed in the agglomerating spray and with the adherence together of the component powders of the agglomerates being effected by the self-cementing actions of such components, which form stable hydrates and/or gels in the presence of water, to bind the powders together in agglomerates, and yet to release them quickly in wash water so that they will be dispersed immediately and will promptly exercise their combined fabric softening function.

The finely powdered bentonite employed is of particle sizes less than No. 100 sieve, U.S. Sieve Series, preferably less than No. 200 sieve, more preferably with essentially all (over 90%) of the particles thereof passing through a No. 325 sieve, and most preferably with all such particles passing through such sieve. It has been found that the sodium sulfate particles to be agglomerated should be of particle sizes less than No. 100 sieve so as to be effective in improving the softening activity of the bentonite particle when the agglomerate is dispersed in an aqueous medium which is used to soften (and preferably also to wash) laundry. Preferably the particle sizes of the sodium sulfate powder will be less than No. 200 sieve and ideally such particles will pass through a No. 325 sieve (or essentially all of them will pass through such a sieve).

While it is important to the effective operation of the present invention that the bentonite and sodium sulfate particles be very finely divided, as indicated, it should be recognized that good improvement of bentonite fabric softening is obtained when the bentonite and sodium sulfate particles to be agglomerated are smaller than No. 100 sieve. Even when some such particles may be larger than No. 100 sieve the presence of a major proportion (by weight) of particles that pass a No. 100 sieve results in significant and noticeable improvement in softening laundry fabrics. Therefore, it is within the present invention to utilize finely divided bentonite and sodium sulfate, for each of which a major proportion by weight is of particles less than No. 100 sieve.

In addition to the particle sizes of the bentonite and sodium sulfate components of the present agglomerates being important it is also important that the proportion of bentonite and sodium sulfate be within a relatively limited range, so as to obtain the desired improvement in the softening effect on the laundry of the bentonite. Thus, the agglomerate will be of 2 to 10 parts of bentonite, by weight, to one part of sodium sulfate. Preferably such proportion will be 3 to 5 parts to one and more preferably it will be 7 to 9 parts of bentonite to two parts of sodium sulfate. Still more preferably the ratio of bentonite to sodium sulfate will be about 4:1. Lesser proportions of sodium sulfate than 1:10 will not appreciably improve the bentonite fabric softening and when greater proportions of sulfate than 1:2 are present softening action is diminished.

The agglomerate made will be of a moisture content in the range of 6 to 16% by weight, preferably 8 to 14%, and more preferably 10 to 12%. Such moisture contents, especially that which is more preferred, have been found to satisfactorily bind the components of the agglomerate together, so that they do not disintegrate on shipping and handling, and yet, help make the agglomerates readily dispersible in wash water so that the full softening affect of the bentonite, as increased by the sodium sulfate, is obtainable.

The agglomerate particle sizes are such that the agglomerated particles are readily pourable from a detergent box or a suitable bottle, and are not dusty. The sizes are also such that the agglomerates will disintegrate readily in aqueous media but will not be size reduced during normal shipping and handling. Additionally, it is preferable for the agglomerates to be of particle sizes like those of any spray dried detergent composition with which they might be mixed to convert it to a fabric softening detergent product. The sizes of the agglomerates which satisfy these conditions are those within the No's. 10 to 140 sieve range, U.S. Sieve Series, and preferably the range is within sieves No's. 30 to 100. Desirably, bulk densities will also be about the same but the same bulk densities are not required, and those in the 0.2 to 0.9 g./cc. or 0.5 to 0.9 g./cc. range are found to result in satisfactorily non-segregating detergent compositions when mixed with spray dried beads of 0.3 to 0.5 g./cc. bulk density when the particle sizes are about the same.

To make the improved fabric softening agglomerates of this invention a mixture of bentonite and sodium sulfate powders is agglomerated by being tumbled in an agglomerating apparatus, such as an inclined drum, which may be equipped with a number of breaker bars, so that the particles are in continuous movement and form a falling "screen" onto which a spray of water may be directed. The finely powdered particles are preferably of a normal particle size distribution before agglomeration and the agglomerates are similarly usually of such normal distribution within their size ranges. After agglomeration (and sometimes after screening, too) the particles will be of sizes in the No's. 10 to 140 sieve range (U.S. Sieve Series), although occasionally some particles as large as No's. 6 and 8 may be present. A preferred size range for the agglomerates is 10 to 100, more preferably 30–100. Still more preferable ranges are 40–100 and 40–80.

Figure 2:
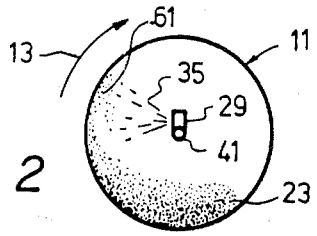

The agglomerating process of this invention will be readily understood from the present specification, taken in conjunction with the drawing, in which:

FIG. 1 is a schematic central longitudinal sectional elevational view of a rotary drum type mixer, with other equipment utilized in the practice of the process of this invention; and FIG. 2 is a transverse sectional view of said rotary drum along plane 2—2, showing the spraying of water onto the tumbling particles of bentonite and sodium sulfate.

In FIG. 1 an open ended, inclined, cylindrical rotary drum 11 is shown rotating about an axis which is at a relatively small acute angle to the horizontal, with such rotation being in the direction shown by arrows 13 and 15. Drum 11 rests on rollers 17, 19 and 21, which rotate in the opposite direction from the drum (counterclockwise, rather than clockwise, viewed from the left), causing it to turn as indicated. Rotary drum 11 contains a mixture 23 of bentonite and sodium sulfate powders which is agglomerated in the drum into fabric softening agglomerate particles, due to the spraying of water onto the particles while the mixture is in motion. Final agglomerated softening particles 25 are removed from drum 11 via chute 27 and are subsequently dried to desired final moisture content (including removable hydrate moisture) in a suitable dryer, not illustrated. Spray nozzles 29, 31 and 33 are employed to produce essentially conical water sprays, represented by numeral 35, which impinge on the moving mixture of bentonite and sulfate powders and promote agglomeration thereof. In the rotating drum, the right or upstream third or similar part is a mixing zone wherein the bentonite and sulfate powders are dry mixed, the middle portion is a spraying and agglomerating zone, and the downstream third or so is one wherein spraying is not effected, the moistened particles and agglomerates are "finished" to relatively free flowing product, and the desired form and character of the agglomerate results, although the moisture content thereof is higher than desired, so that a final drying operation will be undertaken.

The foregoing description relates primarily to a rotary drum which is a preferred embodiment of the apparatus employed in the practice of this invention although other equivalent or substitute means may also be utilized. In addition to the rotary drum, supply means for adding the various final product constituents are provided. Thus, supply tank 37 contains water or other spray solution 39 (as distinguished from spray 35), which is delivered to spray nozzles 29, 31 and 33 through line 41. Hopper bin 43 contains bentonite powder 45 which is delivered to hopper 47 by means of delivery belt 49. Similarly, hopper bin 51 contains sodium sulfate powder 53 which is delivered to hopper 47 by delivery belt 55. Arrows 57 and 59 indicate the directions of such belt movements, respectively.

In FIG. 2 the mixture 23 in drum 11 is shown being carried up the left wall of the drum, which is rotating in the direction of arrow 13. As mix 23 falls downwardly along the face 61 of the upper wall thereof spray 35 of water, sprayed in conical patterns from nozzle 29 and other hidden nozzles 31 and 33, impinges on the moving mixture, moistens the surfaces of the bentonite and sodium sulfate powder particles, and promotes agglomeration of the bentonite and sodium sulfate. Thus, constantly renewing faces or curtains of falling particles are contacted by the sprays and substantially uniform moistening and application of the water spray to the moving particles are obtained, which lead to production of a more uniform and better agglomerated product.

Instead of employing the described inclined drum agglomerator other commercial units may be substituted, such as the O'Brien agglomerator, with breaker bars; and various mixers adapted for agglomerating, such as twin shell or V-blenders, Day mixers, Shugi mixers, etc. Also, the agglomeration process may be either batch or continuous, and may be automated. For various agglomeration processes the powders being agglomerated will usually be about room temperature, 10° to 30° C., but the water may be at any suitable temperature, such as 10° or 20° to 40° or 50° C., with ambient temperature often being preferred. Residence time in the agglomerator will normally be within the range of 10 to 40 minutes, preferably 15 to 30 minutes, but it depends on agglomerator characteristics, rates of feed and speeds (normally 3 to 40 r.p.m.). Usually the agglomeration will be halted when the desired agglomerate size distribution is reached.

After the particles of agglomerate are of sizes larger than No. 100 sieve and after the overspraying onto the moving surfaces of the particles of from 10 to 25% or 15 to 20% of the weight of such particles of water, so that the moisture content of the particles is raised to 15 to 35%, preferably 22 to 28% and more preferably about 25%, the moist agglomerated particles are removed from the agglomerator and are dried, preferably in a fluidized bed dryer, to a moisture content in the range of 6 to 16%, preferably 8 to 14% and more preferably 10 to 12% and, if the mixture of agglomerates contains particles outside the 10 to 140 sieve range the agglomerates are screened or otherwise classified to be within such range, preferably within the 30 to 100 sieve range.

The agglomerate particles produced may be of any suitable bulk density, which will, to some extent, depend on particle size distribution, but usually their bulk density will be within the range of 0.2 to 0.9 g./cc., more preferably 0.3 to 0.5 g./cc. Even when the fabric softener agglomerate particles are of a bulk density in the 0.5 to 0.9 g./cc. range they may be blended with spray dried built synthetic organic detergent beads of similar sizes, and bulk densities of 0.2 to 0.6 g./cc., and will not objectionably separate from them or segregate on storage, transportation and handling. Thus, when mixed with such detergent composition particles to form fabric softening detergents, the composition that results and is dispensed from a box of detergent will be of constant analysis and the desired softening will be obtained when the box is first opened and when it is almost finished.

The fabric softening bentonite-sulfate agglomerates may be used alone for their softening function or they may be employed in conjunction with synthetic detergents, preferably built synthetic organic detergents. The most preferred application of these products is in mixture with particulate synthetic organic anionic detergent compositions, in which the bentonite-sulfate agglomerates provide a fabric softening component. Still, it is within the invention to utilize the agglomerates in other ways for fabric softening, as by adding the agglomerated product to rinse water or to wash water. When mixed with and thereby incorporated in a synthetic organic detergent composition the present non-segregating softening agent is useful together with a wide variety of synthetic organic detergent products, including those made by spray drying, agglomeration, or other manufacturing techniques.

The components of the preferred spray dried unitary built synthetic organic detergent beads include a synthetic organic anionic detergent, or a mixture of such detergents, a builder or a mixture of builders, and moisture, although in many instances various adjuvants may also be present. In some cases a filler, such as sodium sulfate or sodium chloride, or a mixture thereof, may be present in the spray dried beads, too.

Various anionic detergents, usually as sodium salts, may be employed but those which are most preferred are linear higher alkyl benzene sulfonates, higher alkyl sulfates and higher fatty alcohol polyethoxylate sulfates. Preferably, in the higher alkyl benzene sulfonate the higher alkyl is linear and of 12 to 15 carbon atoms, e.g., 12 or 13, and is a sodium salt. The alkyl sulfate is preferably a higher fatty alkyl sulfate of 10 to 18 carbon atoms, preferably 12 to 16 carbon atoms, e.g., 12, and is also employed as the sodium salt. The higher alkyl ethoxamer sulfates will similarly be of 10 or 12 to 18 carbon atoms, e.g., 12, in the higher alkyl, which will preferably be a fatty alkyl, and the ethoxy content will normally be from 3 to 30 ethoxy groups per mole, preferably 3 or 5 to 20. Again, the sodium salts are preferred. Thus, it will be seen that the alkyls are preferably linear or fatty higher alkyls of 10 to 18 carbon atoms, the cation is preferably sodium, and when a polyethoxy chain is present the sulfate is at the end thereof. Other useful anionic detergents of this sulfonate and sulfate group include the higher olefin sulfonates and paraffin sulfonates, e.g., the sodium salts wherein the olefin or paraffin groups are of 10 to 18 carbon atoms. Specific examples of the preferred detergents are sodium linear dodecylbenzene sulfonate, sodium tridecylbenzene sulfonate, sodium tallow alcohol polyethoxy (3 EtO) sulfate, and sodium hydrogenated tallow alcohol sulfate. In addition to the preferred anionic detergents mentioned, others of this well known group may also be present, especially in only minor proportions with respect to those previously described. Also, mixtures thereof may be employed and in some cases such mixtures can be superior to single detergents. The various anionic detergents are well known in the art and are described at length at pages 25 to 138 of the text *Surface Active Agents and Detergents,* Vol. II, by Schwartz, Perry and Berch, published in 1958 by Interscience Publishers, Inc.

Small proportions of fatty acid soaps, e.g., sodium soaps of fatty acids of 10 to 22 carbon atoms, preferably 14 to 18 carbon atoms, e.g., sodium hydrogenated tallow fatty acids soaps, can be employed, in the crutcher or post-added, as foam controllers, when less foam in the washing machine is desirable.

Although anionic detergents are preferred various nonionic detergents of satisfactory physical characteristics may be utilized in place of or with anionic detergents, including condensation products of ethylene oxide and propylene oxide with each other and with hydroxyl-containing bases, such as nonyl phenol and Oxo-type alcohols. However, it is highly preferred that if it is used the nonionic detergent be a condensation product of ethylene oxide and higher fatty alcohol. In such products the higher fatty alcohol is of 10 to 20 carbon atoms, preferably 12 to 16 carbon atoms, and the nonionic detergent contains from about 3 to 20 or 30 ethylene oxide groups per mol, preferably from 6 to 12. Most preferably, the nonionic detergent will be one in which the higher fatty alcohol is of about 12 to 13 or 15 carbon atoms and which contains from 6 to 7 or 11 moles of ethylene oxide. Such detergents are made by Shell Chemical Company and are available under the trade name Neodol® 23-6.5 and 25-7. Among their especially attractive properties, in addition to good detergency with respect to oily stains on goods to be washed, is a comparatively low melting point, which is still appreciably above room temperature, so that they may be sprayed onto spray dried base beads as a liquid, which solidifies.

The water soluble builder employed may be one or more of the conventional materials that have been used as builders or suggested for such purpose. These include inorganic and organic builders, and mixtures thereof. Among the inorganic builders those of preference are the various phosphates, preferably polyphosphates, e.g., tripolyphosphates, such as sodium tripolyphosphate. Of course, carbonates, such as sodium carbonate, and silicates, such as sodium silicate, are also useful builders and may desirably be used separately, in mixture or in conjunction with bicarbonates, such as sodium bicarbonate. Other water soluble builders that are considered to be useful supplements include the various other inorganic and organic phosphates, borates, e.g., borax, citrates, gluconates, NTA and iminodiacetates. Preferably the various builders will be in the forms of their alkali metal salts, either the sodium or potassium salts or a mixture thereof, but the sodium salts are normally highly preferred. In some instances water insoluble builders, such as zeolites, may also be present, e.g., Zeolite 4A.

When the bentonite-sulfate agglomerate particles are mixed with spray dried detergent beads, which are preferably spray dried built synthetic anionic organic detergent beads of the described particle sizes and bulk density, conventional mixing or blending equipment, such as Day mixers, may be utilized and normally only a few minutes time is needed to satisfactorily disperse the agglomerate, which will be a minor proportion of the final composition. The final fabric softening particulate detergent composition that will be made will comprise from 5 to 25% of synthetic organic detergent, preferably all anionic detergent, 20 to 60% of inorganic builder(s) for the detergent, 5 to 40% of water soluble inorganic filler salt, which normally improves the flowability of the composition, 4 to 18% of moisture, largely present as water of hydration of the sulfate, bentonite, builders and any filler present, and 0 to 5% of adjuvant(s), with most such components preferably being in unitary spray dried bead form. Fabric softening bentonite-sodium sulfate agglomerate will constitute the balance of the composition, normally being from 5 to 30% thereof. Such agglomerate will be of 2 to 10 or 3 to 5 parts of bentonite, one part of sodium sulfate and 6 to 16% of moisture and will be of particle sizes in the No's. 10 to 140 sieve size range. The bentonite and sulfate powders that are agglomerated will have major proportions thereof that pass a No. 100 sieve (less than No. 100 sieve size). In preferred embodiments of the fabric softening detergent compositions the synthetic anionic organic detergent will be a sodium linear higher alkyl benzene sulfonate or mixture thereof, the inorganic builder(s) will be selected from the group consisting of sodium tripolyphosphate, sodium silicate, sodium carbonate, and mixtures thereof, the adjuvant(s) will be selected from the group consisting of sodium carboxymethylcellulose, enzyme(s), colorant(s), perfume(s), optical brightener(s), and mixtures thereof, the agglomerate will be one of particle sizes in the range of No's. 30 to 100 sieves, with major proportions of each of the finely divided bentonite and sodium sulfate components being of particle sizes less than No. 200 sieve, with a moisture content in the range of 8 to 14% and with the proportions of bentonite and sodium sulfate being within the range of two parts of sodium sulfate to 7 to 9 parts of bentonite. In such preferred embodiments the proportion of sodium linear higher alkylbenzene sulfonate will be in the range of 10 to 20%, the proportion of inorganic builders will be in the range of 30 to 50%, the proportion of water soluble inorganic filler salt will be in the range of 5 to 30%, the proportion of adjuvants will be in the range of 0.5 to 5% and the proportion of fabric softening agglomerate will be in the range of 10 to 25%. Also, the bulk densities of the product and the component agglomerate and spray dried beads may be in the 0.3 to 0.5 g./cc. range. In a more preferred embodiment of the invention the synthetic anionic organic detergent will be sodium linear dodecyl benzene sulfonate, sodium linear tridecylbenzene sulfonate or mixture thereof, the filler salt will be sodium sulfate, the builders will be sodium tripolyphosphate, sodium silicate and sodium carbonate, the agglomerate will be of a moisture content in the range of 10 to 12%, made from bentonite of particle sizes of about No. 325 sieve or less and sodium sulfate of particle sizes such that a major proportion thereof is less than No. 200 sieve, the proportion of bentonite to sodium sulfate in the agglomerate will be about 4:1, and the agglomerate and spray dried beads (in all cases the spray dried beads constitute the balance of the composition) will be of a bulk density of about 0.4 g./cc. In this more preferred embodiment of the fabric softening detergent composition the proportions of synthetic anionic organic detergent, sodium tripolyphosphate, sodium silicate ($Na_2O:SiO_2=1:2.4$), sodium carbonate, sodium sulfate filler and agglomerate will be 10 to 20%, 20 to 30%, 5 to 12%, 5 to 15%, 5 to 25% and 10 to 20%, respectively.

When the fabric softening detergent composition of this invention is employed to wash laundry it may be used in the usual manner for such products, at conventional concentrations, temperatures and washing conditions. Thus, it is useful in both hot and cold water washing, machine washing and hand washing, and the washed laundry may be dried in an automatic laundry dryer or on a wash line. In all such cases and when the agglomerate is used apart from a fabric softening detergent composition or with such, the proportion of agglomerate employed is a fabric softening proportion and when a detergent composition is present (separate or in mixture with the agglomerate) a detersive proportion is used. The detergent composition containing the agglomerate is more effective in softening washed laundry, especially cotton goods, than the same composition containing a corresponding weight of bentonite alone (without sodium sulfate), either agglomerated or not. However, most significant improvements in fabric softening effects are noted when the laundry is hand washed and line dried after rinsing. Similar results are obtainable when the component spray dried detergent beads and bentonite-sulfate agglomerate are added to wash water together or when washing is effected with the detergent composition beads, and the agglomerated bentonite-sulfate fabric softener is added to the rinse water. Still, it is much preferred, for convenience, to employ the fabric softening detergent composition of this invention.

For machine washing the concentration of the fabric softening bentonite-sodium sulfate agglomerate component of the fabric softening detergent composition will normally be within the range of 0.01 to 0.05% in the wash water, preferably being 0.01 to 0.03% thereof, with the balance of the composition being from 0.04 to 0.20%, preferably 0.04 to 0.12%. Preferably the percentage of fabric softening detergent composition will be 0.05 to 0.15 or 0.25%.

When the laundry is hand washed the concentrations of the compositions are often much higher, sometimes being as high as 1 or 2%, with the agglomerate percentage being up to 0.1 to 0.4%. However, it is desirable for economy's sake to maintain the concentration of the fabric softening detergent composition in the 0.05 to 0.25% range, with the agglomerate being from 0.01 to 0.03 or 0.05%.

While wash water temperatures may be varied widely, usually the water temperature will be in the range of 10° to 60° C., often being 20° to 45° C. However, as in European washing practice, higher temperatures, up to about 90° C., may also be used.

Washing times can range from 5 minutes to 45 minutes and the wash water is preferably of limited hardness, normally not being in excess of 150 p.p.m., as calcium carbonate. The automatic washing machines employed may be of either front- or top-loading designs.

The following examples illustrate but do not limit the invention. Unless otherwise indicated, all parts are by weight and all temperatures are in °C.

EXAMPLE 1

Four parts by weight of finely divided sodium bentonite powder of particle sizes which pass through a No. 325 sieve (U.S. Sieve Series) are mixed with one part by weight of finely divided sodium sulfate (anhydrous), and the mixture is coagglomerated in an agglomerating apparatus like that illustrated in the drawing (or its equivalent), with agglomeration being effected by spraying of a finely divided water spray onto the moving surfaces of the mixing powders, while mixing is being continued. The proportion of water utilized is 22.5%, based on the final weight of the agglomerated particles removed from the rotary drum, and because the bentonite initially contains some moisture the moist agglomerated particles removed are of a moisture content of 25%. Such moisture content is that removable by heating at 105° C. for five minutes, and includes hydrate and gel moisture. The throughput time for agglomeration may be varied, depending on the particular agglomerator used, the starting materials, the spray characteristics and the agglomerator speed, but will normally be about 15 to 30 minutes, which time allows for a conditioning tumbling of the moist agglomerate after the water has been sprayed onto the tumbling powders. The removed agglomerated particles, of particle sizes substantially all of which are in the range of 10 to 140 sieve (U.S. Sieve Series), are then dried in a fluidized bed dryer, through which hot air is blown at an elevated temperature (normally from 50° to 90° C. for a laboratory dryer and 250° to 550° C. for a commercial or plant dryer). The use of the fluidized bed dryer, which maintains the particles in motion during drying, prevents undesired attachment of particles to each other, keeping them in essentially spherical shape, which is desirably free flowing, and promoting efficient and rapid drying, which may take as little as 5 to 20 minutes (throughput time). Drying is continued until the moisture content of the agglomerate particles is about 11%, after which any particles that are outside the range of No's. 30–100 sieve sizes are removed (usually a minor proportion). The resulting 30–100 sieve product is collected and is tested for various important end use properties. When added to water, such as wash water, the agglomerates disperse quickly, all being dispersed satisfactorily within a two minute period. This is important because particles which are slow to disperse may become entrapped in laundry and leave white smears on it, which is especially objectionable when the laundry is dark colored. Also, slow dispersal is often accompanied by poor softening. The particles are tested for strength and are found to be satisfactory, being comparable to spray dried detergent particles in resisting crushing and resulting powdering. When employed in a normal concentration in wash water (0.03%) with a heavy duty laundry detergent of the anionic type (sodium linear higher alkylbenzene sulfonate) satisfactory softening of machine washed cotton laundry is obtained. Such softening performance is awarded a rating of 8 on a scale of 10, which is considered to be acceptable for a commercial product. When the described agglomerate is compared to agglomerated bentonite made by agglomerating the same type of bentonite powder (American Colloid Company AEG-325 mesh sodium bentonite) by means of a dilute sodium silicate solution, the softening power of the product in the test described is significantly inferior to that with the agglomerate of this invention when the same proportions are used under the same conditions. Similarly, it has been found that one can obtain fabric softening with the present bentonite-sodium sulfate agglomerate which is equivalent to that of a measured amount of agglomerated bentonite when appreciably less (often 20% or less) of the bentonite-sulfate agglomerate is employed. Such an improvement is unexpected and is advantageous because, in addition to saving on the content of bentonite needed for adequate softening, it allows the reduction of insolubles in the wash water and decreases the potential for undesired lightening in color of dark colored laundry. Furthermore, often the use of agglomerated bentonite (without the presence of any finely divided sodium sulfate in such agglomerate) with a synthetic organic detergent composition for hand washing of laundry results in unsatisfactory softening at reasonable bentonite concentrations but good softening is obtainable with similar concentrations of the present agglomerates in the wash water.

A processing advantage for the present agglomerate is in the recyclability of particles that are of sizes outside specifications. Such particles do not include binder and so may be recycled without raising of any binder content so as to be above the specified proportion of binder in the product.

EXAMPLE 2

| Component | Percent (by weight) |
|---|---|
| Sodium linear dodecylbenzene sulfonate | 17.0 |
| Sodium tripolyphosphate | 24.0 |
| Sodium silicate ($Na_2O:SiO_2$ = 1:2.4) | 10.0 |
| Sodium carbonate, anhydrous | 10.0 |
| Sodium carboxymethyl cellulose | 0.5 |
| Proteolytic enzyme powder | 0.5 |
| Optical brightener | 0.2 |
| Sodium sulfate (filler) | 7.8 |
| Moisture | 10.0 |
| 4:1 Bentonite-sodium sulfate agglomerate (11% moisture content, on agglomerate as is basis) | 20.0 |
| | 100.0 |

A spray dried heavy duty (built) synthetic anionic organic detergent composition of the above formula (less the agglomerate) is made by a conventional spray drying process and is of particle sizes in the range of 30 to 100 sieve (U.S. Sieve Series), a moisture content of 12.5% and a bulk density of about 0.4 g./cc. The 4:1 (weight proportion) 0.7 g./cc. bentonite-sodium sulfate agglomerate is made according to the process described in Example 1. The two products are blended together in a conventional mixer, such as a Day mixer, or twin-shell blender, and because they are of about the same particle size distribution, and close enough bulk densities may be mixed together to form an essentially homogeneous particulate fabric softening detergent composition containing 20% of the bentonite-sodium sulfate agglomerate particles. Such composition is non-settling during shipment, storage and use, and such non-settling characteristics thereof are verifiable by shake-testing of boxes thereof and analyzing samples from different box locations.

Cotton terry towels are washed in a home laundry type washing machine at a concentration of the fabric softening detergent composition of 0.15% in city water of about 100 p.p.m. mixed calcium (3 parts) and magnesium (2 parts) hardness, as $CaCO_3$, at a temperature of 25° C., using a wash cycle of about 45 minutes, including rinsing. The towels are line dried and after drying are evaluated for softness by a panel of experienced evaluators (of fabric softness). The panel found the towels to be satisfactorily soft (equivalent to a softness rating of 8 on a scale of 10). However, when a coarser sodium sulfate powder is employed, of which only a minor proportion is of particle sizes smaller than No. 100 sieve, to make a bentonite-sodium sulfate agglomerate of the same formula, by the process of Example 1, and when such agglomerate is incorporated in a fabric softening detergent composition of the same formula as that previously given in this example, the product resulting is not satisfactory for use as a fabric softening laundry detergent composition. In comparative tests the panel of evaluators found such product to be substantially inferior to that incorporating the agglomerate based on the more finely divided sodium sulfate. The acceptable fine sodium sulfate powder includes 81% by weight of sodium sulfate powder which passes through a No. 100 sieve, and 55% by weight of such powder which passes through a No. 200 sieve, whereas the coarser sodium sulfate includes only 28% by weight of powder which passes through a No. 100 sieve. In another such experiment wherein the agglomerate is made with sodium sulfate with 60% thereof passing through a No. 100 sieve the softening effect of the fabric softening detergent composition made with such agglomerate is also superior to that in which the agglomerate is based on the described "coarse" sodium sulfate. It is considered that best results are obtained when all the sodium sulfate passes a No. 200 sieve and it is also considered useful, although not as good, for all the sulfate to pass a No. 100 sieve. When, instead of employing any of the described bentonite-sodium sulfate agglomerates, a bentonite (only) agglomerate is substituted in the above experiments, softening results, as evaluated by the panel, are decidedly inferior to the results obtained when agglomerates and fabric softening detergent compositions within this invention are tested.

EXAMPLE 3

| Component | Compositions and Component Percentages (by weight) | | | |
|---|---|---|---|---|
| | A | B | C | D |
| Sodium linear dodecyl benzene sulfonate | 14 | 14 | 14 | 14 |
| Sodium tripolyphosphate | 26 | 26 | 26 | 26 |
| Sodium silicate ($Na_2O:SiO_2$ = 1:2.4) | 9 | 9 | 9 | 9 |
| Sodium carbonate (anhydrous) | 5 | 5 | 5 | 5 |
| Sodium carboxymethyl cellulose | 0.5 | 0.5 | 0.5 | 0.5 |
| Optical Brightener | 0.4 | 0.4 | 0.4 | 0.4 |
| 4:1 Bentonite-fine sodium sulfate agglomerate (major proportion of sulfate passing through a No. 200 sieve) | 12 | 10 | — | — |
| Bentonite (only) agglomerate (dilute aqueous sodium silicate binder) | — | — | 12 | — |
| Moisture | 10 | 10 | 10 | 10 |
| Sodium sulfate (filler) | 23.1 | 25.1 | 23.1 | 35.1 |
| | 100.0 | 100.0 | 100.0 | 100.0 |

Fabric softening particulate detergent compositions of the above formulas are made by the process described in Example 2. Using the evaluation test described in that example, with some variations, different cotton terry towels are washed in different wash waters at 38° C., which contain 0.25% of each of the above formulas of detergent compositions (three of which contain fabric softening components). A full load of laundry (about 3.5 kg.) is used in each case and the washing machine used is a standard top loading home washing machine. The washed and rinsed laundry loads are line dried and after drying are evalulated for softness by the panel of evaluators. The panel rated Composition A as softening better than Composition B, which was rated as about equal in softening effect to Composition C, which was much better in softening than Composition D. These experiments show that the presence of the finely divided sodium sulfate in the agglomerates of Compositions A and B make those compositions more effective fabric softeners than Composition C, which contains about 50% more of softening agent (bentonite) than Composition B and about 25% more than Composition A.

EXAMPLE 4

A fabric softening detergent composition like that of Example 3A is made but containing 18% of the bentonite-sodium sulfate agglomerate instead of the 12% of that example. For comparison, a similar fabric softening detergent composition is made in which the 18% of bentonite-sodium sulfate agglomerate is replaced by 18% of bentonite (alone) agglomerate (with only a very minor proportion of sodium silicate binding agent also being present). Cotton terry towels are washed in a plastic tub by hand, with the concentration of the fabric softening detergent composition being about 1%, after which the towels are rinsed in clear water and are line dried. A panel of evaluators then compares the towels for softness. The panel found that the towels washed with fabric softening detergent composition containing bentonite and sodium sulfate were of satisfactory softness but those washed with the detergent composition containing bentonite agglomerate (without sodium sulfate) were not satisfactorily soft. Thus, for hand washing of laundry the invented compositions, containing the described agglomerates, are effective in softening the washed laundry and bentonite (only) agglomerates are inferior in this respect in similar detergent compositions.

EXAMPLE 5

Results similar to those described in the previous examples are obtainable when other anionic detergents are substituted for sodium dodecylbenzene sulfonate, such as sodium linear tridecylbenzene sulfonate and mixtures thereof with sodium lauryl sulfate, and other anionic detergents of the types previously described in the specification, when other builders (previously described) are used, when other bentonites are employed and when minor adjuvants, such as colorants, are included with the bentonite and sodium sulfate to be agglomerated. Also, the proportions given in the various examples that are within the invention may be varied ±10% and ±25%, while remaining within the ranges specified, and the results obtained will be satisfactory, like those described.

In the previous specification and in the foregoing working examples it has been shown that a significant advance in the art of producing fabric softening heavy duty laundering compositions based on bentonite (and comparable smectite clays) has been made in the discovery of the potentiating effect of finely divided sodium sulfate, in minor proportion, agglomerated with fabric softening bentonite powder. By means of the present invention one is able to diminish the proportion of bentonite employed in fabric softening detergent compositions without losing any fabric softening effect. The sodium sulfate utilized has no significant adverse effects on detergent products, and is a known component of various detergent compositions, often due to its presence therein as a detergent byproduct. Also, any disadvantages that could otherwise result from the use of greater proportions of bentonite to obtain additional softening are obviated, such as color lightening of darker colored laundry due to the presence of such larger proportion of bentonite in the wash water.

The invention has been described with respect to bentonite, as the fabric softening smectite clay, and sodium sulfate, both of which are components of the invented fabric softening agglomerate. However, it is considered that in addition to or at least in partial replacement of bentonite other smectite clays with textile softening properties may be employed, and other finely divided water soluble ionizable salt may be substituted, at least in part, for sodium sulfate, with improved softening being obtainable compared to similar compositions from which such salt component has been omitted from the agglomerate. Still, while fabric softening smectite clays other than bentonite and water soluble salts other than sodium sulfate may also be useful, it is considered that the described bentonite-sodium sulfate agglomerates are superior to such other compositions in fabric softening properties, and are exceptional in this respect.

The invention has been described with respect to various illustrations and working embodiments thereof but it is not to be considered as limited to these because it will be evident that one of skill in the art, with the present specification before him, will be able to utilize substitutes and equivalents without departing from the invention.

What is claimed is:

1. A fabric softening bentonite-sodium sulfate agglomerate which comprises agglomerate particles of sizes in the range of No's. 10 to 140 sieves, U.S. Sieve Series, which are agglomerates of mixtures of finely divided bentonite and sodium sulfate, with at least a major proportion by weight of each of the bentonite and sodium sulfate particles being less than No. 100 sieve size, with the proportions of bentonite and sodium sulfate being within the range of one part of sodium sulfate by weight to 2 to 10 parts of bentonite by weight, with the bentonite and sodium sulfate particles being held together in the agglomerate particles by hydrated bentonite and hydrated sodium sulfate at the surfaces of said particles, and with the agglomerate particles being of a moisture content in the range of 6 to 16%, by weight.

2. An agglomerate according to claim 1 wherein the proportions of bentonite and sodium sulfate are within the range of one part of sodium sulfate by weight to 3 to 5 parts of bentonite by weight.

3. An agglomerate according to claim 2 wherein the particle sizes thereof are in the range of No's. 30 to 100 sieves, major proportions of each of the finely divided bentonite and sodium sulfate are of particle sizes less than No. 200 sieve, the proportions of bentonite and sodium sulfate are within the range of two parts of sodium sulfate to 7 to 9 parts of bentonite and the agglomerate particles are of a moisture content in the range of 8 to 14%.

4. An agglomerate according to claim 3 wherein the finely divided bentonite is of particle sizes of about No. 325 sieve or less, the proportion of bentonite to sodium sulfate is about 4 to 1, and the agglomerate particles are of a moisture content in the range of 10 to 12%.

5. A fabric softening particulate detergent composition which comprises from 5 to 25% of synthetic anionic organic detergent, 20 to 60% of inorganic builder(s) for the detergent, 5 to 40% of water soluble inorganic filler salt, 4 to 18% of moisture and 0 to 5% of adjuvant(s), in spray dried bead form, and 5 to 30% of fabric softening bentonite-sodium sulfate agglomerate in accordance with claim 1.

6. A detergent composition according to claim 5 wherein the synthetic anionic organic detergent is sodium linear higher alkylbenzene sulfonate and the proportion thereof is in the range of 10 to 20%, the proportion of inorganic builder(s) is in the range of 30 to 50%, said builder(s) is/are selected from the group consisting of sodium tripolyphosphate, sodium silicate, sodium carbonate and mixtures thereof, the proportion of water soluble inorganic filler salt is in the range of 5 to 30%, the proportion of adjuvant(s) is in the range of 0.5 to 5%, the adjuvant(s) is/are selected from the group consisting of sodium carboxymethyl cellulose, enzyme(s), colorant(s), perfume and optical brightener(s), and mixtures thereof, the proportion of fabric softening agglomerate is in the range of 10 to 25%, the agglomerate is in accordance with claim 2, and the spray dried beads and the agglomerate are each of a bulk density in the range of 0.3 to 0.5 g./cc.

7. A detergent composition according to claim 6 wherein the proportion of synthetic anionic organic detergent is in the range of 10 to 20%, the detergent is sodium linear dodecylbenzene sulfonate, sodium linear tridecylbenzene sulfonate or a mixture thereof, the proportions of inorganic builders are 20 to 30% of sodium tripolyphosphate, 5 to 12% of sodium silicate of $Na_2O$:-$SiO_2$ ratio of 1:2.4, and 5 to 15% of sodium carbonate, the water soluble inorganic filler salt is sodium sulfate, the proportion thereof is about 5 to 25%, the agglomerate is in accordance with claim 4, the proportion thereof is 10 to 20%, and the spray dried beads and the agglomerate are each of a bulk density of about 0.4 g./cc.

8. A process for manufacturing fabric softening bentonite-sodium sulfate agglomerate particles which comprises mixing together particles of bentonite and sodium sulfate, with major proportions of particle sizes less than No. 100 sieve, U.S. Sieve Series, in a proportion of bentonite to sodium sulfate in the range of 2 to 10 parts of bentonite per one part of sodium sulfate, by weight, and, while continuing mixing of the materials, overspraying onto the moving surfaces of the particles sufficient water to cause the particles to agglomerate to particles of sizes larger than No. 100 sieve and of moisture content in the range of 15 to 35%, drying the moist agglomerated particles to a moisture content in the range of 6 to 16%, while maintaining the particles in motion, and collecting such dried particles of sizes in the range between No's. 10 and 140 sieves.

9. A process according to claim 8 wherein the bentonite and sodium sulfate particles that are mixed together are of particle sizes less than No. 200 sieve, the proportion of bentonite to sodium sulfate is within the range of 7 to 9 parts of bentonite to 2 parts of sodium sulfate, the proportion of moisture oversprayed onto the moving surfaces of the particles is from 10 to 25% of the weight of such particles, the moisture content of the moist agglomerate particles is raised by the overspraying so as to be in the range of 22 to 28%, the moist agglomerated particles are dried to a moisture content in the range of 8 to 14%, and the collected dried particles are of sizes in the range of No's. 30 to 100 sieves and of a bulk density in the range of 0.3 to 0.5 g./cc.

10. A method of simultaneously washing and softening laundry fabrics which comprises washing laundry in wash water containing a washing concentration of a built synthetic organic anionic detergent composition and a fabric softening concentration of a bentonite-sodium sulfate agglomerate according to claim 1, rinsing the laundry and drying it.

11. A method according to claim 10 wherein the laundry is hand washed in water at a temperature in the range of 20° to 45° C. and is line dried.

12. A method according to claim 10 wherein the wash water is at a temperature in the range of 20° to 45° C. and contains 0.05 to 0.25% of a detergent composition according to claim 7, the washing is machine washing, and the drying is by line drying.

* * * * *